US007980843B2

(12) United States Patent
Zimmerman et al.

(10) Patent No.: US 7,980,843 B2
(45) Date of Patent: Jul. 19, 2011

(54) CONCRETE DISPENSING APPARATUS FOR PRE-CAST CONCRETE FORMS

(75) Inventors: Melvin M. Zimmerman, Denver, PA (US); Carl S. Martin, East Earl, PA (US); Matthew S. Hildebrand, Ephrata, PA (US)

(73) Assignee: SWA Holding Company, Inc., Wilmington, DE (US)

( * ) Notice: Subject to any disclaimer, the term of this patent is extended or adjusted under 35 U.S.C. 154(b) by 1035 days.

(21) Appl. No.: 11/508,060

(22) Filed: Aug. 22, 2006

(65) Prior Publication Data

US 2008/0048351 A1 Feb. 28, 2008

(51) Int. Cl.
*B67D 3/00* (2006.01)

(52) U.S. Cl. ..... 425/147; 425/135; 222/482

(58) Field of Classification Search ..... 222/482, 222/478, 481; 425/145, 147, 135, 146
See application file for complete search history.

(56) References Cited

U.S. PATENT DOCUMENTS 2,332,688 A * 10/1943 Baily ..... 404/102
3,833,693 A * 9/1974 Ross ..... 264/40.4
4,278,190 A * 7/1981 Oory et al. ..... 222/561
4,624,195 A * 11/1986 Doering ..... 111/12
4,751,803 A 6/1988 Zimmerman ..... 52/414
5,055,252 A 10/1991 Zimmerman ..... 264/263
5,656,194 A 8/1997 Zimmerman ..... 249/160
6,494,004 B1 12/2002 Zimmerman ..... 52/251
2002/0141822 A1 * 10/2002 Sterner ..... 404/75

* cited by examiner

*Primary Examiner* — Christina Johnson
*Assistant Examiner* — Galen Hauth
(74) *Attorney, Agent, or Firm* — Miller Law Group, PLLC

(57) ABSTRACT

A concrete dispensing apparatus is used in a manufacturing process for producing pre-cast concrete structures, which are conventionally used to form a foundation for a residential or commercial building. The dispensing apparatus includes a hopper that funnels to a discharge opening extending along the entire transverse length of the dispensing apparatus. A plurality of individually controlled gates cover the entire discharge opening for selectively controlling the length and location of the discharge opening through which concrete is dispensed. The dispensing apparatus also includes a finishing mechanism including a vibratory screed and a rotational finishing roller. The form can be moved relative to the dispensing apparatus or vice versa. A form vibrator induces a vibratory motion into the form to remove air from the dispensed concrete mixture. Operative control is accomplished through an operator control panel operable to control a hydraulic system powering the operative functions of the dispensing apparatus.

19 Claims, 10 Drawing Sheets

Fig. 2
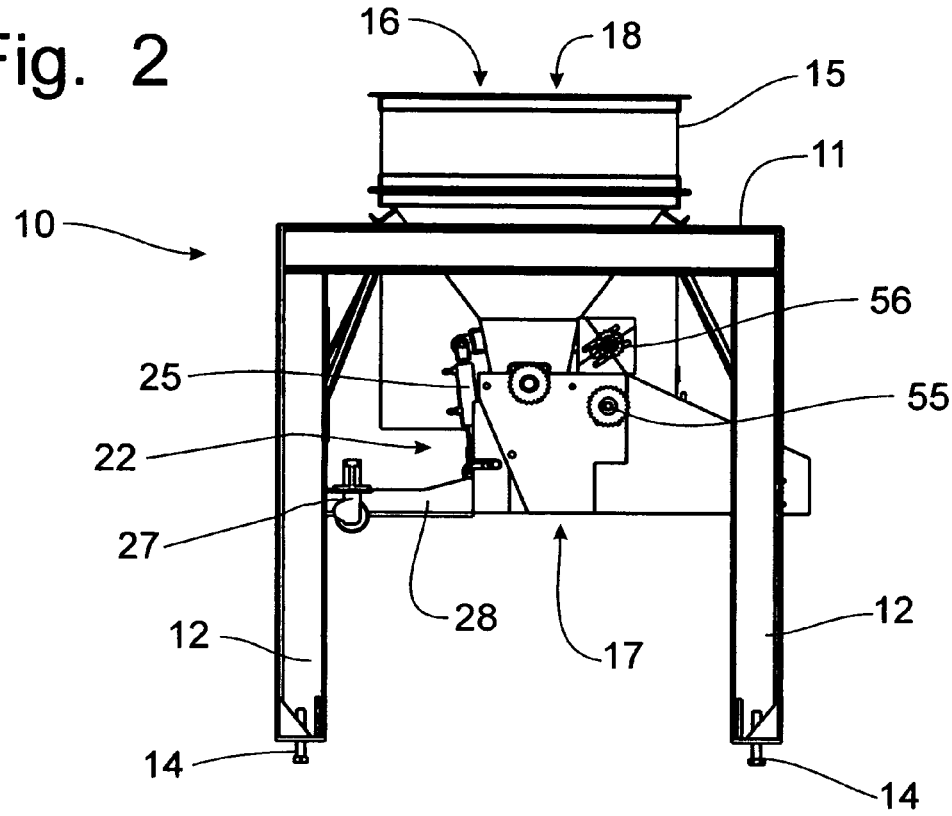
Fig. 8
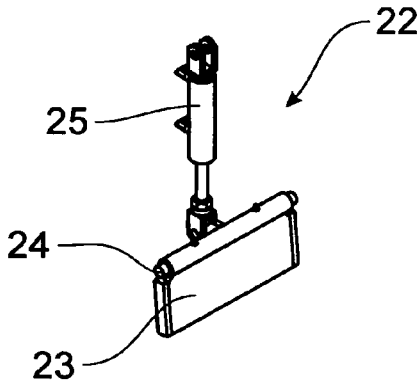
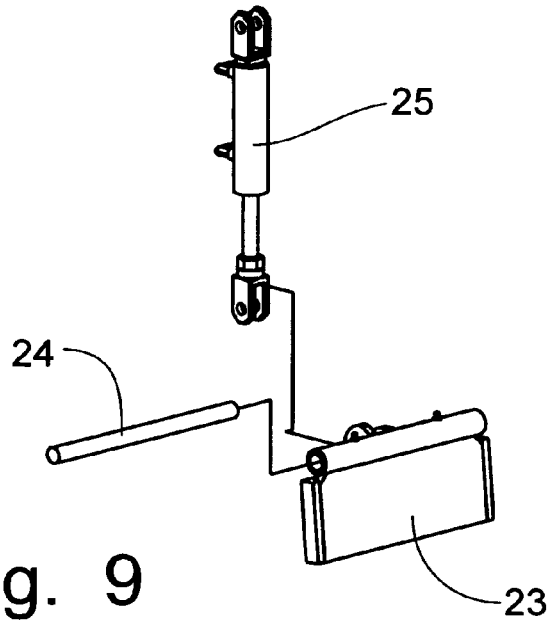
Fig. 9

CONCRETE DISPENSING APPARATUS FOR PRE-CAST CONCRETE FORMS

FIELD OF THE INVENTION

The present invention relates generally to the formation of pre-cast concrete structures, and, more particularly, to a dispensing apparatus for distributing concrete mixture into a form corresponding to the pre-cast concrete structure.

BACKGROUND OF THE INVENTION

Pre-cast concrete structures, such as the type disclosed in U.S. Pat. No. 4,751,803, issued to Melvin M. Zimmerman on Jun. 21, 1988, are commonly utilized in the construction of foundation walls for residential and commercial buildings. Improvements to the basic pre-cast process have been made over the years, as are represented in U.S. Pat. No. 5,055,252, issued to Melvin M. Zimmerman on Oct. 8, 1991; in U.S. Pat. No. 5,656,194, granted on Aug. 12, 1997, to Melvin M. Zimmerman; and in U.S. Pat. No. 6,494,004, issued on Dec. 17, 2002, to Melvin M. Zimmerman. In generally terms, the process involves setting up the form with a polystyrene foam bottom and reinforcing members appropriately positioned, then pouring a concrete mixture into the form. After hardening, the side members of the form are stripped away from the now hardened concrete structure and the concrete structure is loaded onto a truck for delivery to the job site to be assembled into a foundation wall with other similar pre-cast structures.

In some instances, openings, such as for windows and doors to be added to the pre-cast concrete structure, are formed as part of the pre-cast concrete form. Concrete mixture is not to be added to the part of the form corresponding to the window or door openings. Similarly, two or more pre-cast concrete structures can be set-up into a single form into which the concrete mixture is to be added. In such situations, a transverse divider is provided between the concrete structures so that the side members and the dividers can be stripped away from the independent hardened concrete structures before shipping.

Once the form is set-up, a concrete mixture is dispensed into the form to fill the form. This process is typically accomplished through conventional chutes or tubular concrete dispensing devices during which the dispensing device is moved back and forth across the form until the form is filled appropriately with concrete mixture, working around any openings that are established within the form. Dispensing the concrete mixture into the form presents an opportunity to improve the process, reduce manufacturing time, decrease costs and improve profits.

Accordingly, it would be desirable to provide an apparatus that would be capable of dispensing concrete mixture into forms corresponding to pre-cast concrete structures.

SUMMARY OF THE INVENTION

It is an object of this invention to provide a dispenser apparatus that is operable to dispense concrete mixture into a pre-cast concrete structure form.

It is a feature of this invention that the concrete dispensing apparatus moves relative to the pre-cast structure form to dispense concrete mixture into the form from one side thereof to the other.

It is an advantage of this invention that the concrete dispensing apparatus dispenses concrete mixture into the pre-cast structure form along the entire transverse length simultaneously as the concrete dispensing apparatus moves from one side of the form to the other side.

It is another feature of this invention that the concrete dispensing apparatus includes a plurality of gates along the transverse length thereof.

It is still another advantage of this invention that each gate can be independently opened or closed to control the dispensing of concrete mixture within the form.

It is yet another advantage of this invention that the portions of the concrete dispensing apparatus overlying openings formed in the pre-cast structure form can be closed by shutting the corresponding gates until the dispensing apparatus has moved past the formed opening.

It is still another feature of this invention that the concrete dispensing apparatus incorporates a finishing mechanism behind the hopper containing a supply of concrete mixture to be dispensed.

It is still another advantage of this invention that the top surface of the concrete poured into the filled pre-cast structure form will be finished as the concrete dispensing apparatus is moved relative to the form from one side to the other.

It is yet another feature of this invention that the finishing mechanism includes a vibratory screed and a rotated finishing roller.

It is still another feature of this invention that the concrete dispensing apparatus includes a form vibrator engagable with the ends of the form to induce a vibratory motion into the form to settle the concrete mixture and remove air therefrom.

It is yet another feature of this invention that the operative functions of the concrete dispensing apparatus are independently controlled through a control mechanism cooperable with a hydraulic system.

It is another object of this invention to provide a concrete dispensing apparatus that would be operable to dispense a concrete mixture into a pre-cast concrete structure form that is moved beneath the dispensing apparatus, as well as a concrete dispensing apparatus that is movable over top of a stationary pre-cast structure form.

It is a further feature of this invention that the concrete dispending apparatus incorporates a hopper for holding a supply of concrete mixture.

It is still a further feature of this invention that the hopper has a larger opening at the top thereof for the receipt of concrete mixture into the hopper, than the discharge opening controlled by the plurality of gates.

It is a yet another feature of this invention that the hopper incorporates an auger that prevents bridging of the concrete mixture and provides uniform dispersion of the concrete mixture along the transverse length of the hopper.

It is a further advantage of this invention that the concrete mixture is uniformly spread across the bottom of the hopper for substantially equal dispensing of the concrete mixture through the open gates at the discharge opening of the hopper.

It is still a further feature of this invention that the operative control of the concrete dispensing apparatus is provided by an operator stationed adjacent the control panel for the dispensing apparatus.

It is yet another object of this invention to provide a concrete dispensing apparatus for use with a pre-cast concrete structure form, which is durable in construction, inexpensive of manufacture, carefree of maintenance, facile in assemblage, and simple and effective in use.

These and other objects, features and advantages are accomplished according to the instant invention by providing a concrete dispensing apparatus for use in a manufacturing process for producing pre-cast concrete structures that are conventionally used to form a foundation for a residential or commercial building. The dispensing apparatus includes a hopper that funnels to a discharge opening extending along the entire transverse length of the dispensing apparatus. A plurality of individually controlled gates cover the entire discharge opening to selectively control the length and location of the discharge opening. The dispensing apparatus also includes a finishing mechanism including a vibratory screed and a rotational finishing roller, which can be powered or unpowered. The form can be moved relative to the dispensing apparatus or vice versa. A form vibrator induces a vibratory motion into the form to remove air from the dispensed concrete mixture. Operative control is accomplished through an operator control panel operable to control a hydraulic system powering the operative functions of the dispensing apparatus.

BRIEF DESCRIPTION OF THE DRAWINGS

The advantages of this invention will be apparent upon consideration of the following detailed disclosure of the invention, especially when taken in conjunction with the accompanying drawings wherein:

FIG. 2 is a side elevational view of the concrete dispensing apparatus shown in FIG. 1;

FIG. 8 is a perspective detail view of a discharge gate mounted at the bottom of the hopper to control the size and location of the discharge opening;

FIG. 9 is an enlarged, exploded detail view of the discharge gate shown in FIG. 8;

DETAILED DESCRIPTION OF THE PREFERRED EMBODIMENT

Figure 1:
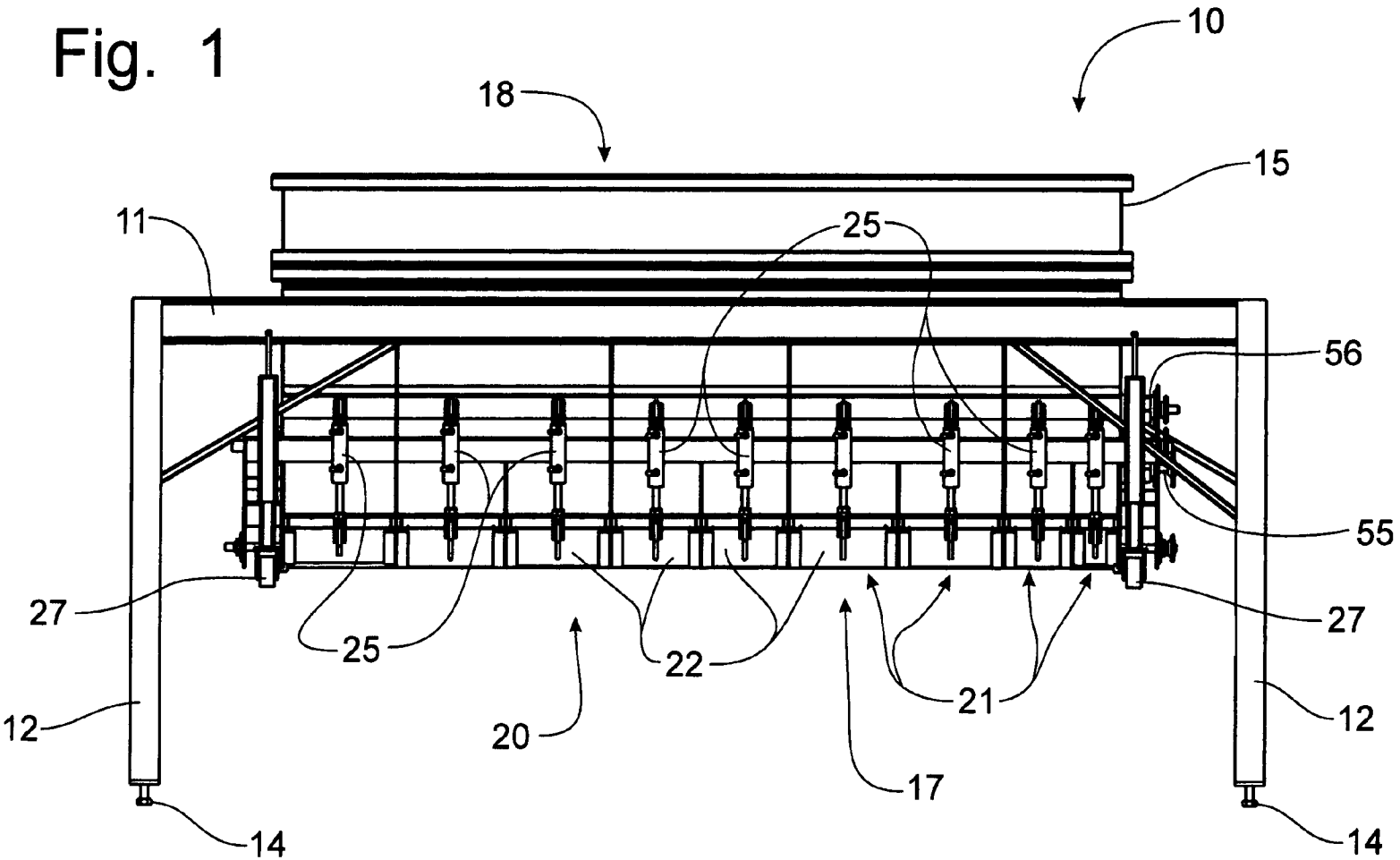
FIG. 1 is a front elevational view of a concrete dispensing apparatus incorporating the principles of the instant invention.
Figure 3:
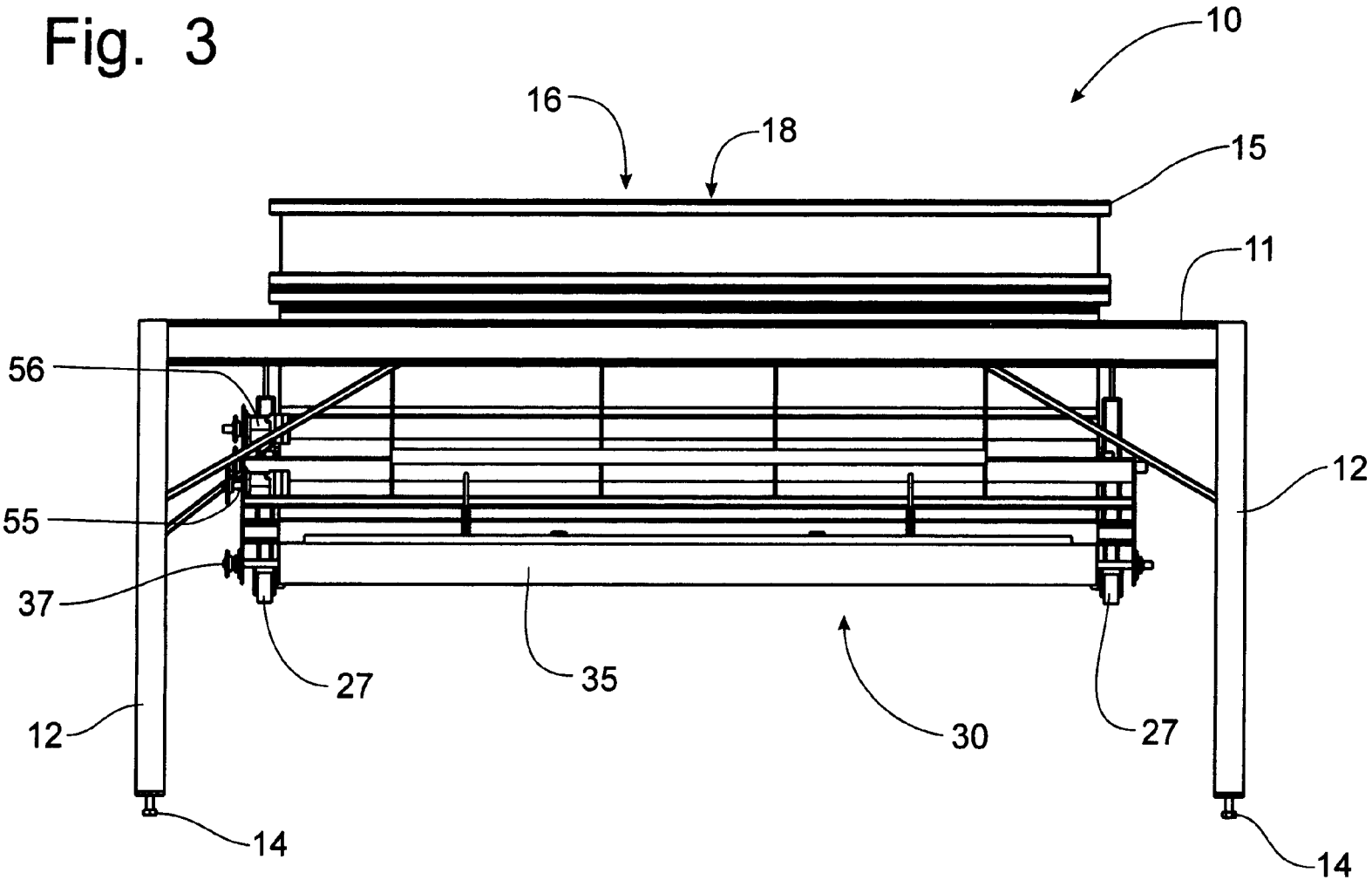
FIG. 3 is a rear elevational view of the concrete dispensing apparatus depicted in FIG. 1.

Referring now to FIGS. 1-6, an apparatus for dispensing a concrete mixture into a form can best be seen. The apparatus is intended for use in conjunction with forms for making pre-cast concrete structures, such as foundation wall sections that can be transported to a building site and assembled to create a foundation for the residential or commercial building to be constructed. In the forms that are assembled for creating such modular concrete foundation wall panels, openings for doors or windows are required. While the concrete mixture is to be poured generally into the wall panel form, the concrete mixture is not to be poured into the openings that are also configured into the form. The concrete dispenser 10 to be described below is intended to be moved relative to the modular foundation wall panel form to be filled with concrete mixture. The concrete dispenser 10 can be moved relative to the form, or the form can be moved relative to a fixed position concrete dispenser 10. This later configuration is deemed preferable and is the configuration of the invention shown in the drawings.

The concrete dispenser 10 is formed with a frame 11 supporting a hopper 15 having upright walls that define a cavity 16 for receiving and storing on a temporary basis a supply of hydrated concrete mixture for dispensing into a form or mold. The upright walls of the hopper 12 converge toward the bottom of the hopper 12 to form a discharge opening 17 that is significantly narrower than the inlet opening 18 at the top of the hopper 12 into which the hydrated concrete mixture is delivered. The frame 11 can be adapted for movement along a form, such as by having wheels (not shown) that will travel on tracks or the like along a stationary form. In the drawings, the frame 11 is provided with legs 12 that are configured to support the hopper 15 in a stationary manner above the form so that the form can be moved beneath the hopper 15. Preferably, the legs 12 have adjustable feet 14 that can be positionally adjusted, such as by threading into the legs 12, to level the frame 11 at the job site.

The hopper 15 has a gate mechanism 20 mounted thereon at the discharge opening 17 so that the discharge of hydrated concrete mixture from the hopper 15 can be selectively controlled. The discharge opening 17 is subdivided into multiple ports 21 and the gate mechanism 20 includes a control gate 22 mounted at each port 21 to be operated independently from each other control gate 22 mounted on the hopper 15. As best seen in FIGS. 8 and 9, each control gate 22 includes a door 23 pivotally mounted on a pivot rod 24 carried by the hopper 15 and a hydraulic actuator mounted on the outside of the hopper 15 and connected to the door 23 to cause pivotal movement thereof in response to extension and contraction of the hydraulic actuator 25. The number, spacing and sizes of the control gates 22 can be configured to the typical pre-cast foundation wall panel that is made during the manufacturing process. As depicted in the drawings, the preferred embodiment is to provide 9 control gates 22 spanning the transverse width of the hopper 15. Preferably, as best seen in FIG. 1, the control gates 22 located near the center and at the one end of the hopper 15 have a smaller size to permit flexibility in the delivery of concrete mixture around blocked out openings in the wall panel.

Figure 13:
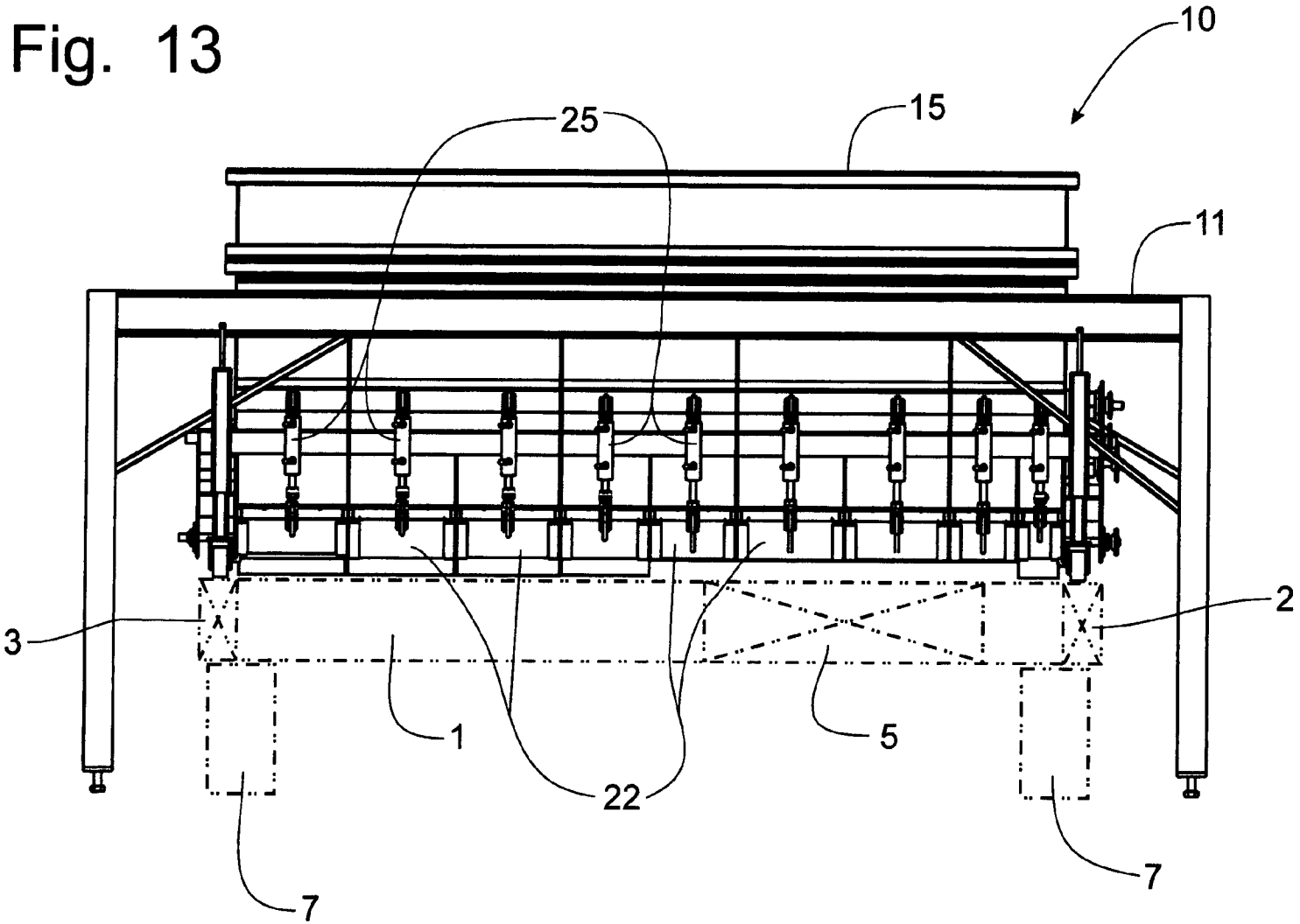
FIG. 13 is a front elevational view of the concrete dispensing apparatus in operation dispensing concrete mixture around a formed opening in the wall panel form.

Referring now to FIG. 13, a representative form 1 for a wall panel having an opening 5 formed into the structure of the wall panel is shown positioned below the hopper 15 to receive hydrated concrete mixture therefrom. Counting from the bottom of the form 1 at the left side of the drawing, the first four control gates 22 are opened to dispense the hydrated concrete mixture into the form. The fifth through eighth control gates 22 are closed as each of these control gates 22 fully or partially overlap the opening 5. The ninth control gate 22 is opened to deliver hydrated concrete mixture into the form 1 above the opening 5. Once the form 1 has moved such that the hopper no longer overlies the opening 5, the fifth through eighth control gates 22 will be opened to dispense concrete mixture across the entire transverse width of the form 1.

As can be seen in FIGS. 1-7 and 13, extending forwardly from the transverse ends of the hopper 15 are form vibrators 27 that are positioned to engaged the top and bottom form members 2, 3, respectively, and transfer thereto a vibratory motion. Preferably, each of the vibrators 27 are extended forwardly of the discharge opening 17 by an arm 28. The purpose of the form vibrators 27 is to induce vibration into the wall panel form to induce air trapped in the concrete mixture being dispensed from the hopper 15 to be released and to slump the concrete mixture within the wall panel form to evenly distribute the hydrated concrete mixtures throughout the confines of the form.

Preferably, the hopper 15 also supports rearwardly thereof a surface finishing apparatus 30 to work the top surface of the concrete mixture once poured into and distributed within the wall panel form. The finishing apparatus 30 preferably includes a vibratory screed 32 that levels and smoothes the top surface of the concrete mixture. The screed 32 preferably has at least two vibrators 33 mounted thereon for the same purposes as the form vibrators 27, i.e. to encourage trapped air to leave the concrete mixture and to distribute the concrete mixture across the transverse width of the vibratory screed 32. In general structural terms, the screed 32 is a flat panel extending rearwardly of the hopper 15 to engage, level and smooth the concrete mixture dispensed through the discharge opening 17.

Rearwardly of the vibratory screed 32 is a roller trowel 35 to give a final finish to the top surface of the concrete mixture after the screed 32 has performed its respective function. The roller trowel 35 is to further smooth the top surface of the concrete mixture to provide a watery layer, sometimes called the cream, to appear evenly across the surface of the concrete mixture. Preferably, the roller trowel 35 is powered in rotation in opposition to the direction of movement of the forms beneath the concrete dispenser 10, although the finishing roller 35 could also be powered to rotate in the same direction as the movement of the forms. Alternatively, the finishing roller 35 can be unpowered and will rotate in the same direction as the movement of the forms due to frictional contact with the forms and the surface of the concrete mixture. The driving of the rotation of the roller trowel 35 is preferably accomplished through a hydraulic system to be described in greater detail below; however, the outboard end of the roller trowel 35 has a sprocket 37 mounted thereon for operative connection to a drive chain. Alternatively, the powered rotation of the finishing roller 35 can be accomplished in other conventional ways, such as a direct coupling of a hydraulic motor on the end of the roller 35. The finishing apparatus 30 can be mounted at an angle to the path of travel of the form, or perpendicular thereto as is depicted in the drawings.

Figure 4:
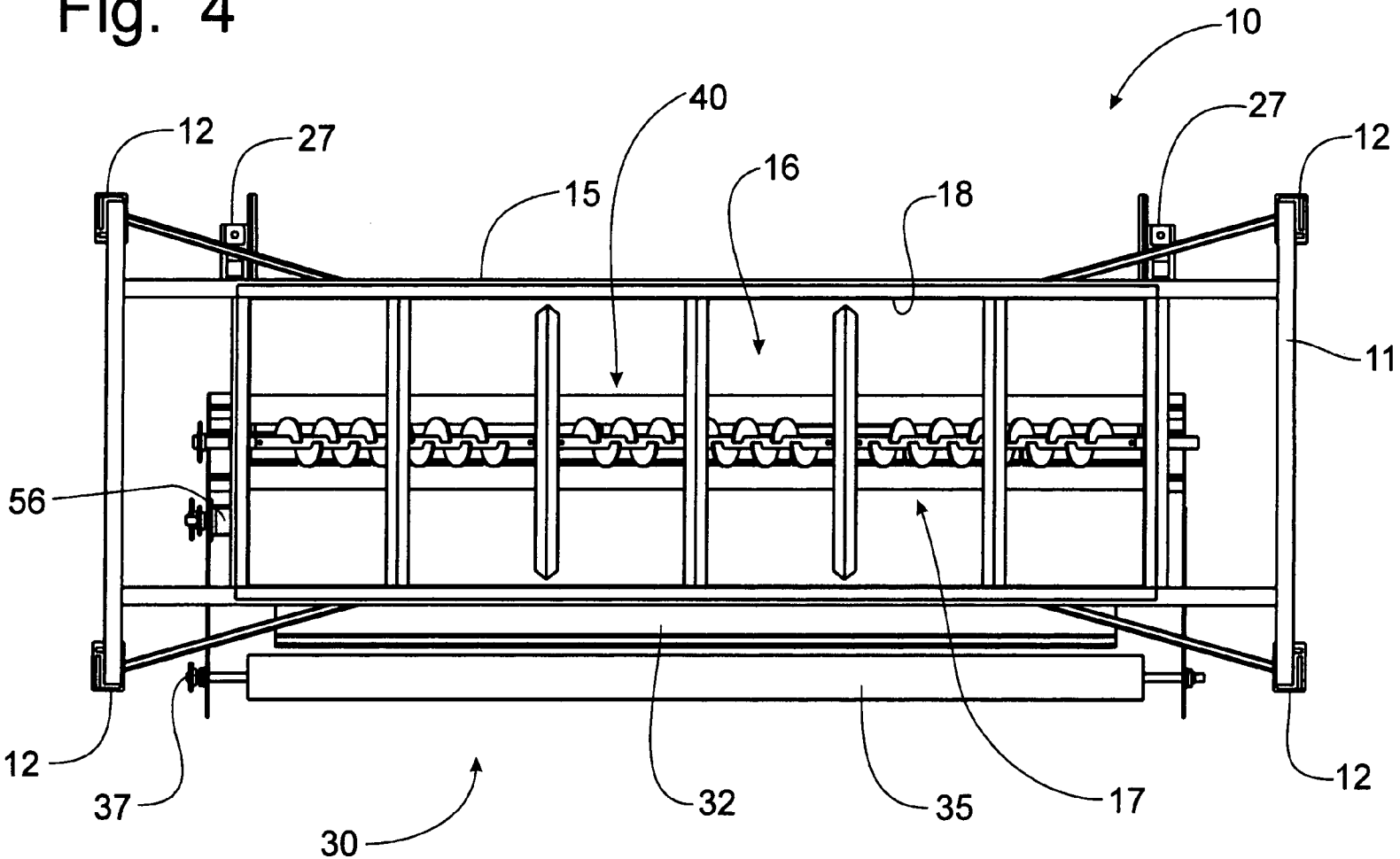
FIG. 4 is a top plan view of the concrete dispensing apparatus depicted in FIG. 1.
Figure 5:
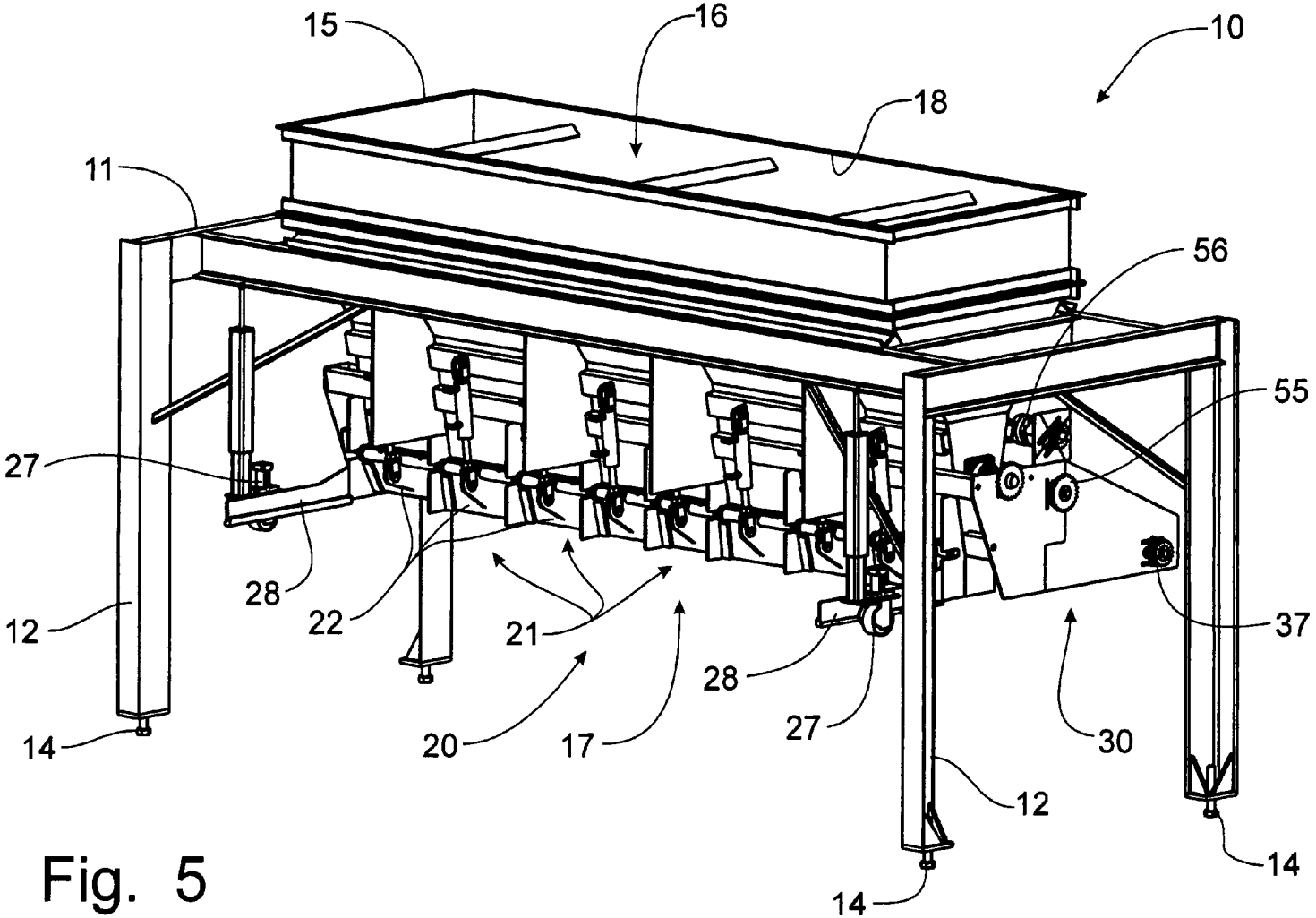
FIG. 5 is a front perspective view of the concrete dispensing apparatus shown in FIGS. 1-4.
Figure 6:
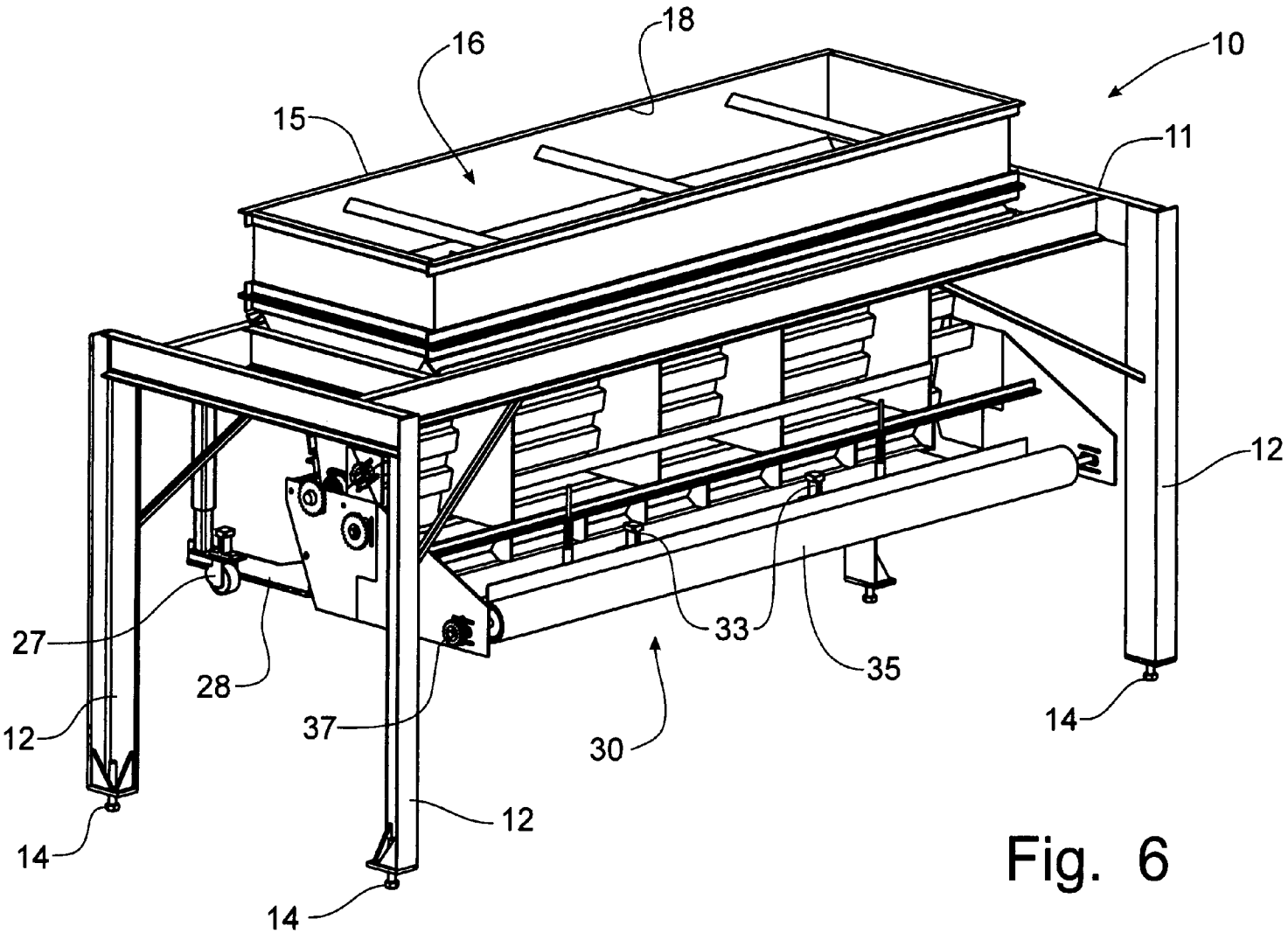
FIG. 6 is a rear perspective view of the concrete dispensing apparatus depicted in FIGS. 1-4.
Figure 7:
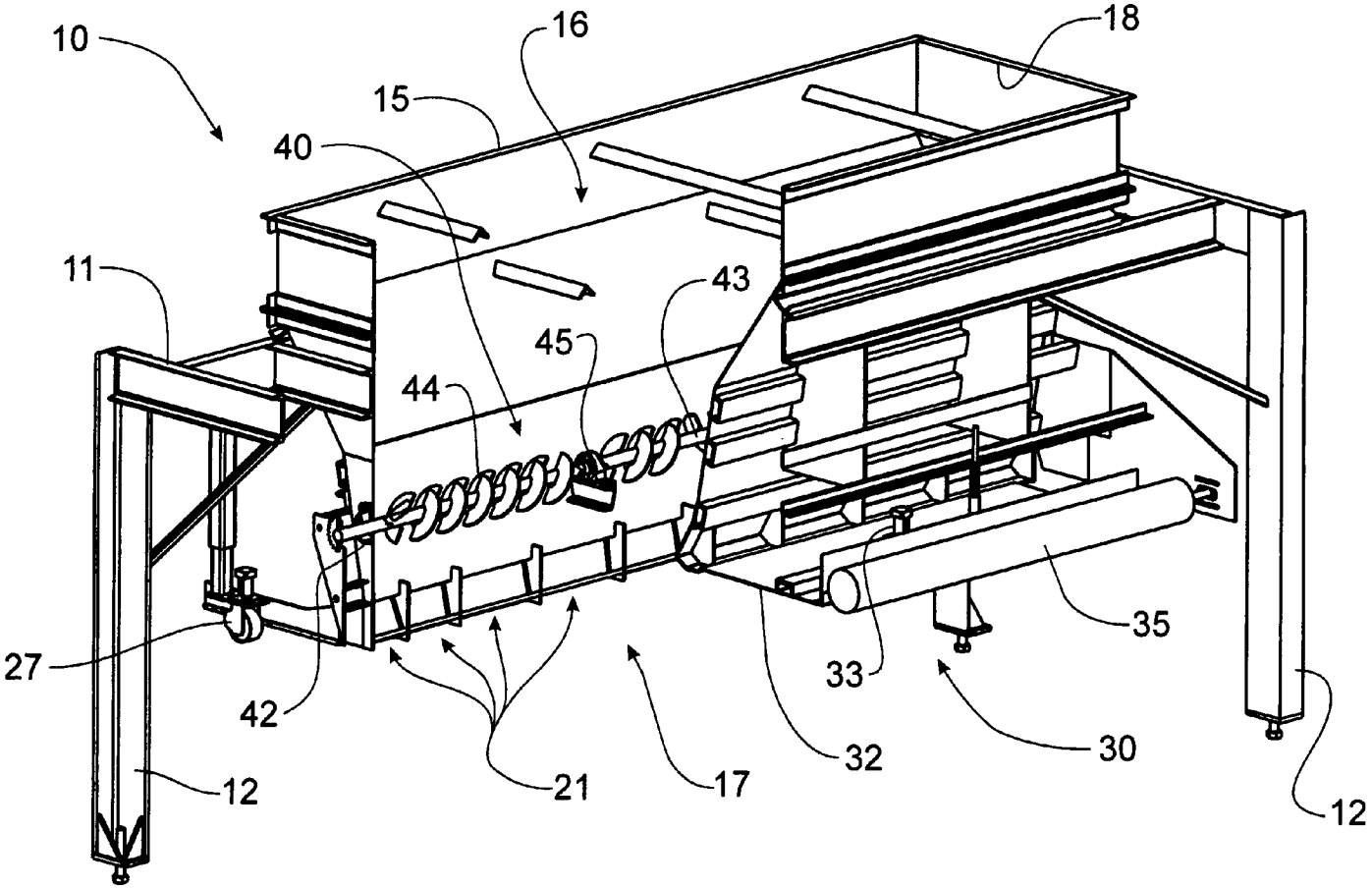
FIG. 7 is a rear perspective view of the concrete dispensing apparatus similar to that of FIG. 6, but having a portion thereof broken away to better view the auger mechanism located within the hopper.

As best seen in FIGS. 4 and 7, an auger 40 is mounted internally of the cavity 16 of the hopper 15 extending from one transverse end of the hopper 15 to the other. The auger 40 serves to prevent bridging of the hydrated concrete mixture within the narrowing cavity 16 of the hopper 15, and to evenly distribute the concrete mixture across the transverse width of the discharge opening, which is particularly important as the cavity 16 is emptied of concrete mixture to be dispensed. The auger 40 includes a central rotatable shaft 43 and interrupted auger flighting 44 welded to the central auger shaft 43 to convey concrete mixture within the hopper 15. The central shaft 43 is rotatably supported by two outer end bearings 42 mounted on the end walls of the hopper 15 and by at least one interior sealed bearing 45 mounted in the interior of the hopper 15. Preferably, the flighting 44 is arranged to convey the concrete mixture toward or away from the center of the hopper 15, depending on the direction of rotation of the auger shaft 43.

Figure 10:
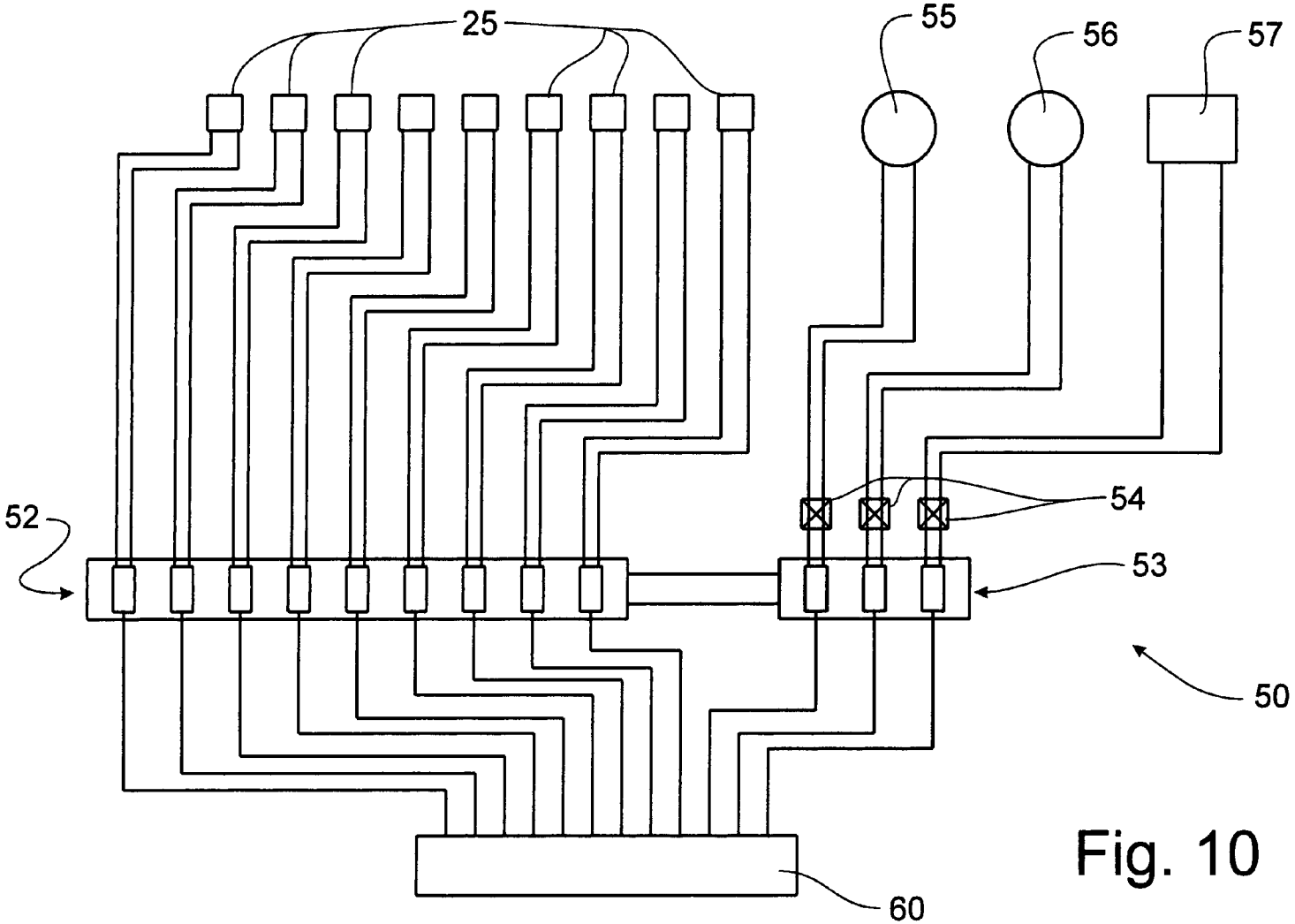
FIG. 10 is a schematic diagram of the hydraulic system powering the operation of the concrete dispensing apparatus.

The operative functions of the concrete dispenser 10 are preferably coupled in an operative manner to a hydraulic system 50 depicted schematically in FIG. 10. Hydraulic fluid is supplied under pressure from a tank (not shown) to a bank of electric solenoid valves 52 that is operable to control the flow of hydraulic fluid to each hydraulic cylinder 25 associated with the gate mechanism 20. The solenoid valves 52 are controlled through switches 62 mounted at the top of a control box 60, best seen in FIGS. 14 and 15. The hydraulic system 50 further includes a bank of solenoid valves 53 that are coupled with flow control valves 54 to control the operation of drive motors associated with the roller trowel 35, the auger 40 and the movable forms.

Hydraulic fluid circulated to the hydraulic motor 55 drives the rotation of the roller trowel 35 through a chain drive (not shown) coupled to the sprocket 37 in a known manner. Similarly, the auger 40 is driven from the hydraulic motor 56, which is separately controlled from the other hydraulic components. Since the wall panel form (or in the alternative the concrete dispenser 10) has to be moved underneath the hopper 15, the drive mechanism (not shown) for moving the form (or in the alternative, moving the concrete dispenser 10 relative to the form) is powered through a hydraulic motor 57 controlled through the control box 60 so that the operation of the entire process can be effectively controlled by the operator from a single location. The form vibrators 27 and the screed vibrators 33 are preferably conventional vibratory drives powered through compressed air, although the vibrators 27, 33 could be hydraulically driven as well.

Figure 12:
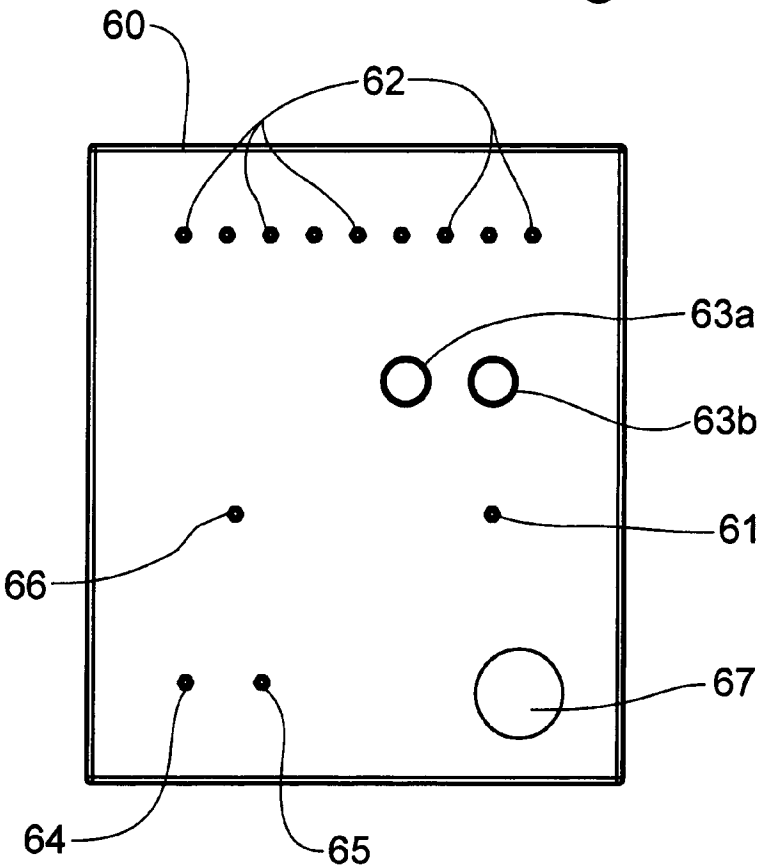
FIG. 12 is an elevational view of the control panel shown in FIG. 11.
Figure 11:
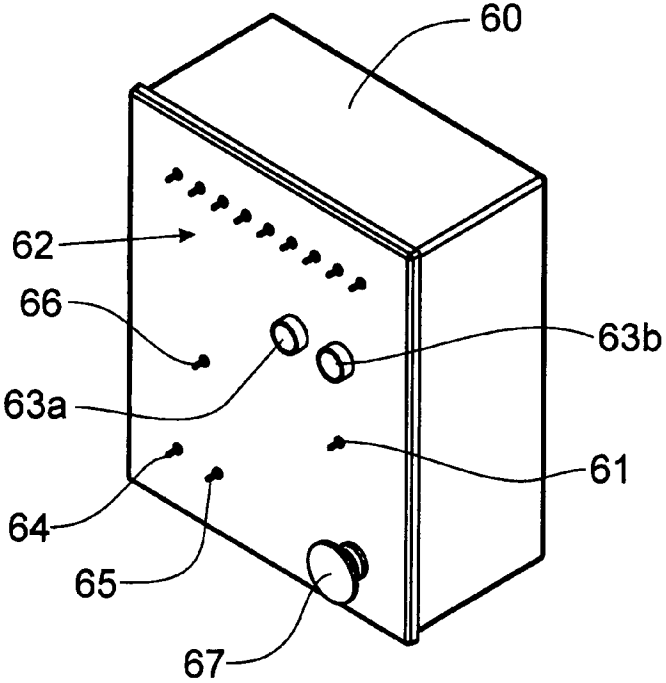
FIG. 11 is a perspective view of the control panel operatively connected to the hydraulic system for controlling the operation thereof.

As seen in FIGS. 11 and 12, the control box 60 is provided with an array of toggle switches 62 at the top of the control box 62, with each respective switch being operable to control the extension and contraction of each respective hydraulic cylinder 25 associated with the gate mechanism 20. A pair of override switches 63*a*, 63*b* is preferably associated with the gate mechanism to cause all hydraulic cylinders 25 to extend to close all gates simultaneously (switch 63*a*) or to contract and open all gates simultaneously (switch 63*b*), regardless of the settings of the individual switches 62. The control box 60 is also provided with a main power switch 61 to activate or deactivate the control system. Separate switches are provided to control the forward and reverse functions of the auger (through toggle switch 64), the roller trowel (through toggle switch 65) and the track drive mechanism of the form (through toggle switch 66). An emergency stop button 67 is also provided to provide an instantaneous halt to all operations of the concrete dispenser 10 and associated mechanisms.

In operation, the concrete dispenser 10 is coupled operatively to an apparatus (not shown) for mixing and conveying an appropriate hydrated concrete mixture into the cavity 16 of the hopper 15. Such apparatus for mixing and conveying the hydrated concrete mixture is usually more efficiently operated when the concrete dispenser 10 is stationary. Thus, as reflected in FIG. 13, the preferred embodiment is to have the form 1 move underneath a stationary concrete dispenser 10. The forms 1 require a track mechanism 7 that is operable to move the form in a linear manner relative to the concrete dispenser 10. The track mechanism 7 is operatively coupled to the drive motor 66 controlled through the control box 60.

The transverse length of the hopper 15 and the discharge opening 17 at the bottom portion of the hopper 15 is substantially the same width as the wall panel form to be filled with the concrete mixture. The form vibrators 27 are positioned on the end members 2, 3 of the forms 1 to induce a vibrational movement into the forms 1 to be transferred to the concrete mixture to be dispensed therein. Once the concrete dispenser 10 passes over the first side wall of the empty wall panel form 1 to be positioned over the empty form, the operator hits the "All Open" override switch 63*b* to contract all of the hydraulic cylinders 25 and open all ports covering the entire discharge opening 17. The concrete mixture is then dispensed from the hopper 15 through all ports into the form 1. Assuming that this particular foundation wall panel is a solid panel with no window or door openings to be formed therein, the operator hits the "All Close" override switch 63*a* to extend all hydraulic cylinders and close each port of the discharge opening 17 when the concrete dispenser 10 reaches the opposing side wall of the form 1.

As the concrete dispenser 10 dispenses the concrete mixture into the wall panel form from one side wall to the other, the trailing finishing apparatus 30 works the top surface of the concrete mixture to level off the concrete mixture with the vibratory screed 32 and then smooth the top surface of the concrete mixture by the rotating roller trowel 35 trailing the screed 32. Since the concrete dispenser 10 is preferably stationary, the movement of the form below the hopper 15 allows the finishing apparatus 30 to provide a smooth, level surface from one end member of the form to the other and from one side wall of the form to the other.

In situations where a window or door opening 5, or some other wall feature in which no concrete is desired, is blocked out within the wall panel form 1, the operator will hit the "All Open" override switch 63*b* to initiate the flow of concrete mixture through all ports of the discharge opening 17, assuming that the respective opening 5 is not positioned at the initial side wall of the wall panel form 1. When the discharge opening 17 approaches the opening 5 in which no concrete mixture is desired, the operator flips the switch or switches 62 corresponding to the ports that overlie in whole or in part the opening 5 to close the control gates 22 for those particular ports. Even ports that only partially overlie the opening 5 are closed as no concrete mixture into the blocked out opening 5 is desired. The operator may have to slow down the speed of operation of the track mechanism 7 moving the form 1 relative to the concrete dispenser 10, such as by momentarily halting the movement while the concrete mixture continues to flow into the form 1, depending on the number of open ports through which concrete mixture is being delivered.

When the operator sees that the discharge opening 17 has cleared the blocked out opening 5, he can either hit the "All Open" override switch 63*b* again to open all control gates 22 or re-open each individual gates by manipulation of the switches 62 corresponding to the closed control gates 22. Where two openings 5 in the form transversely overlap each other, the operator has the control to open and close each appropriate control gate 22 to continue the flow of concrete mixture into the form 1, except into the blocked out openings 5. With appropriate manipulation of the switches 64, 65 on the control box 60, the operator can also control the direction of operation of the internal auger 40 and the roller trowel 35. Rotational speed control can also be provided either through an appropriate control device (not shown) on the control box 60 or by manually changing the settings on the corresponding flow control valve 54. Forward and reverse operation of the auger 40 can dislodge an obstruction or help break up bridging, or to change the direction of flow of concrete mixture toward or away from the center of the hopper 15 so that the even distribution of the concrete mixture across the entire discharge opening can be maintained.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A concrete dispensing apparatus for use in the manufacture of pre-cast concrete structures having a form into which a hydrated concrete mixture is to be distributed, comprising:

a frame;

a transversely oriented hopper supported by said frame above said form to dispense said concrete mixture into the form, said hopper having upright walls defining a cavity including an upper inlet opening into which said concrete mixture is loaded into said hopper cavity and a lower discharge opening through which said concrete mixture is dispensed from said hopper into said form, said discharge opening being divided into a plurality of ports, each said port including an opening dimension defined by a transverse width, at least one of said ports having said opening dimension smaller than the other said ports; and a plurality of control gates mounted on said hopper at said discharge opening, each said control gate corresponding to one of said ports and is independently movable between a closed position in which said control gate covers the corresponding said port to prevent said concrete mixture from being dispensed therethrough and an open position in which said concrete mixture is permitted to flow through the corresponding said port, each said control gate having a transverse width substantially equal to the opening dimension of the corresponding said port, each said control gate including an actuator for affecting said movement between said open and closed positions.

2. The concrete dispensing apparatus of claim 1 further comprising:

a surface finishing apparatus mounted behind said hopper to finish a top surface of said concrete mixture within said form passing beneath said surface finishing apparatus.

3. The concrete dispensing apparatus of claim 2 wherein said surface finishing apparatus includes:

a screed panel for leveling said concrete mixture within said form; and a finishing member mounted behind said screed panel to smooth said top surface of said concrete mixture after being leveled by said screed panel.

4. The concrete dispensing apparatus of claim 3 wherein said screed panel has a vibrational device mounted thereon to transmit a vibratory motion to said screed panel and said concrete mixture in contact with said screed panel, said finishing member being a rotatable roller trowel.

5. The concrete dispensing apparatus of claim 3 wherein said hopper has a converging wall section terminating in said discharge opening, said concrete dispensing apparatus further comprising a rotatable auger mounted in said cavity within said converging wall section above said discharge opening to distribute evenly said concrete mixture to said ports.

6. The concrete dispensing apparatus of claim 5 wherein said auger is formed with flighting that is oriented from each respective end of said auger toward a center point thereof such that said auger, depending on the direction of rotation thereof, is operable to convey concrete mixture toward the center point or away from the center point.

7. The concrete dispensing apparatus of claim 6 wherein said auger is rotatably supported by end bearings mounted on said hopper walls and by at least one interior bearing mounted within said hopper cavity.

8. The concrete dispensing apparatus of claim 5 further comprising:

a hydraulic system operably connected to said actuators for affecting movement of said control gates, to a first hydraulic motor for delivering rotational power to said auger, and to a second hydraulic motor for delivering rotational power to said roller trowel; and a control system including an electric solenoid valve for each said actuator, an electric flow control valve for each said hydraulic motor, and a control switch corresponding to each said valve to control the independent operation thereof from a central control panel.

9. The concrete dispensing apparatus of claim 8 wherein said control panel further includes a first and second override switches operable to actuate all of said electric solenoid valves corresponding to said control gates into said open position and said closed position, respectively.

10. The concrete dispensing apparatus of claim 8 wherein said form is mounted on a track mechanism to cause movement of said form beneath said hopper, said hydraulic system including a third hydraulic motor for driving said track mechanism, said control system including an electric flow control valve operably connected to said third hydraulic motor and a control switch corresponding to said third hydraulic motor for the independent control thereof.

11. In a concrete dispenser for distributing a hydrated concrete mixture into a form for the manufacture of a pre-cast concrete structure, the improvement comprising:

a transversely extending hopper supported above said form to dispense said concrete mixture into the form, said hopper having upright walls defining a cavity including an upper inlet opening into which said concrete mixture is loaded into said hopper cavity and a lower discharge opening through which said concrete mixture is dispensed from said hopper into said form, said discharge opening being divided into a plurality of ports, each said port having an opening defining a transverse width; and a plurality of control gates mounted on said hopper at said discharge opening corresponding, respectively, to each said port to be independently movable between a closed position in which said control gate covers the corresponding said port to prevent said concrete mixture from being dispensed therethrough and an open position in which said concrete mixture is permitted to flow through the corresponding said port, each said control gate being pivotally mounted on a transversely oriented pivot rod and including an actuator for affecting said movement between said open and closed positions, each said control gate being movable vertically about said transverse pivot rod from said closed position to said open position.

12. The concrete dispenser of claim 11 further comprising a surface finishing apparatus including:

a screed panel for leveling said concrete mixture within said form after being dispensed into said form from said hopper; and a rotatable roller trowel mounted behind said screed panel to smooth said top surface of said concrete mixture after being leveled by said screed panel.

13. The concrete dispenser of claim 12 further comprising:

a hydraulic system operably connected to said actuators for affecting movement of said control gates; and a control system including an electric solenoid valve for each said actuator and a control switch corresponding to each said solenoid valve to control the independent operation thereof from a central control panel, said control system further including first and second override switches operable to actuate all of said electric solenoid valves into said open position and said closed position, respectively.

14. A concrete dispenser for use in the manufacture of pre-cast concrete structures having a form into which a hydrated concrete mixture is to be distributed from said concrete dispenser, comprising:

a frame;

a transversely extending hopper supported by said frame above said form to dispense said concrete mixture into the form, said hopper having upright walls defining a cavity including an upper inlet opening into which said concrete mixture is loaded into said hopper cavity and a lower discharge opening through which said concrete mixture is dispensed from said hopper into said form, said discharge opening being divided into a plurality of ports, each said port including an opening dimension defined by a transverse width of said port, the opening dimension of at least one of said ports being smaller than the other said ports;

a plurality of control gates mounted on said hopper at said discharge opening, each said control gate corresponding to one of said ports and is independently movable between a closed position in which said control gate covers the corresponding said port to prevent said concrete mixture from being dispensed therethrough and an open position in which said concrete mixture is permitted to flow through the corresponding said port, each said control gate having a transverse width substantially equal to the opening dimension of the corresponding said port, each said control gate being pivotally mounted on a transversely extending pivot rod and including an actuator for affecting said movement between said open and closed positions, each said control gate being pivotally movable generally vertically from said closed position to said open position, each said actuator being supported on said hopper in a vertical orientation; and a surface finishing apparatus mounted behind said hopper to finish a top surface of said concrete mixture within said form passing beneath said surface finishing apparatus, said surface finishing apparatus including:

a screed panel for leveling said concrete mixture within said form; and a rotatable finishing member powered by a hydraulic motor.

15. The concrete dispenser of claim 14 wherein said ports are linearly positioned along said hopper and include central ports, first end ports and second end ports, said ports at said second end having opening dimensions smaller than said ports at said first end.

16. The concrete dispenser of claim 15 wherein said port in said central portion have smaller opening dimensions than said ports on said first end.

17. The concrete dispenser of claim 14 wherein said form is mounted on a track mechanism to cause movement of said form beneath said hopper which is maintained in a stationary position above the moving form.

18. The concrete dispenser of claim 17 further comprising:

a hydraulic system operably connected to said actuators for affecting movement of said control gates and for advancing the movement of said form beneath said hopper; and a control system including an electric solenoid valve for each said actuator to control the independent operation thereof and of the movement of said form from a central control panel.

19. The concrete dispenser of claim 18 wherein said control panel further includes a first and second override switches operable to actuate all of said electric solenoid valves corresponding to said control gates into said open position and said closed position, respectively.

* * * * *